US008834763B2

(12) United States Patent
Hadba et al.

(10) Patent No.: US 8,834,763 B2
(45) Date of Patent: Sep. 16, 2014

(54) CROSS LINKED FIBERS AND METHODS OF MAKING SAME USING TRANSITION METAL IONS

(75) Inventors: Ahmad Robert Hadba, Middlefield, CT (US); Sebastien Ladet, Lyons (FR)

(73) Assignees: Covidien LP, Mansfield, MA (US); Sofradim Production (FR)

( * ) Notice: Subject to any disclaimer, the term of this patent is extended or adjusted under 35 U.S.C. 154(b) by 111 days.

(21) Appl. No.: 13/120,683

(22) PCT Filed: Feb. 22, 2010

(86) PCT No.: PCT/IB2010/000610

§ 371 (c)(1), (2), (4) Date: Jun. 27, 2011

(87) PCT Pub. No.: WO2010/095050

PCT Pub. Date: Aug. 26, 2010

(65) Prior Publication Data

US 2011/0294962 A1 Dec. 1, 2011

Related U.S. Application Data

(60) Provisional application No. 61/154,380, filed on Feb. 21, 2009.

(51) Int. Cl.

| | |
|---|---|
| ***D01D 5/08*** | (2006.01) |
| ***D01F 6/86*** | (2006.01) |
| ***D01F 6/96*** | (2006.01) |
| ***D01F 6/62*** | (2006.01) |
| ***D01D 5/38*** | (2006.01) |
| ***D01F 6/66*** | (2006.01) |

(52) U.S. Cl.

CPC .. *D01F 6/66* (2013.01); *D01F 6/86* (2013.01); *D01F 6/96* (2013.01); *D01F 6/62* (2013.01); *D01D 5/38* (2013.01)

USPC ..... 264/178 F; 264/176.1; 264/178 R; 264/211.24; 525/410; 525/411; 525/415; 525/437; 525/450

(58) Field of Classification Search

USPC ..... 525/410, 411, 415, 437, 450; 264/176.1, 178 R, 178 F, 211.24

See application file for complete search history.

(56) References Cited

U.S. PATENT DOCUMENTS

| | | | | |
|---|---|---|---|---|
| 5,455,308 | A | 10/1995 | Bastiaansen | |
| 6,399,197 | B1 * | 6/2002 | Kanamori et al. | 428/378 |
| 2003/0162903 | A1 | 8/2003 | Day | |
| 2009/0054619 | A1 * | 2/2009 | Baker et al. | 528/354 |
| 2009/0220607 | A1 * | 9/2009 | Kiser et al. | 424/487 |
| 2009/0297609 | A1 * | 12/2009 | Shoichet et al. | 424/489 |

OTHER PUBLICATIONS

Britain, J.W.; Gemeinhardt, P.G.; Journal of Applied Polymer Science, 1960, p. 207-211.*

Himo, F., et al.; Journal of the American Chemical Society, 2005, p. 210-216.*

Ossipov, D.A.; Hilborn, J.; Macromolecules, 2006, p. 1709-1718.*

Heaton, A.; The Chemical Industry, 2nd edition, 1994, p. 138-139.*

Copy of International Search Report PCT/IB2010/000610 dated Jun. 10, 2010.

* cited by examiner

*Primary Examiner* — Robert Jones, Jr.

(57) ABSTRACT

The present disclosure relates to a method of forming fibers. First and second precursors, each possessing a core and at least one functional group known to have click reactivity, are mixed in a hopper. The mixed precursors are then extruded through an extrusion die to crosslink and produce a filament. Polymerization of the first and second precursors is catalyzed by transition metal ions.

18 Claims, 5 Drawing Sheets

CROSS LINKED FIBERS AND METHODS OF MAKING SAME USING TRANSITION METAL IONS

CROSS-REFERENCE TO RELATED APPLICATIONS

This application is a U.S. National Stage Application filed under 35 U.S.C. §371(a) of International Application No. PCT/IB2010/000610, filed Feb. 22, 2010, which claims the benefit of and priority to U.S. Provisional Patent Application Ser. No. 61/154,380 filed Feb. 21, 2009, the entire contents of which are incorporated by reference herein.

BACKGROUND

1. Technical Field

The present disclosure relates to crosslinked fibers, and more particularly to the use of click chemistry to form the crosslinked fibers using transition metal ions, methods of preparing such fibers, and surgical devices made from such fibers.

2. Background of Related Art

Methods for making monofilaments that are suitable to fabricate surgical articles, such as sutures, generally include the steps of extruding at least one bioabsorbable or nonbioabsorbable polymer to provide filaments, drawing or stretching the solidified filaments to achieve molecular orientation, and annealing the drawn filaments to relieve internal stresses.

Various spinning methods may be employed, such as melt spinning, gel spinning, wet or dry spinning, and reaction spinning. Melt spinning uses heat and potentially shear to melt the fiber-forming polymer to a viscosity suitable for extrusion through the die or spinneret. After exiting the die, the fiber solidifies by cooling in air or a suitable chilled fluid bath. In solvent spinning, the fiber-forming polymer is dissolved in a suitable organic solvents or solvent mixture to result in a fluid with suitable viscosity for extrusion through a spinneret. The difference between wet and dry spinning is the means by which the fiber solidifies. In dry spinning, the fiber solidifies as the solvent evaporates under a stream of air or inert gas. In wet spinning, the fiber forms by precipitating from solution as a result of dilution in a non-solvent bath or chemical reaction with a crosslinker in the solvent bath. Gel spinning refers to a process similar to solvent spinning except that the polymer is not fully dissolved in the solvent—a high polymer content is used in the process. The chains of the partially solvated polymer are aligned by the shear during the extrusion process. The filaments are further drawn as they are passed through a gas drying then a wet precipitating bath. The resulting fibers have an unusually high degree of alignment and high tensile strength relative to conventional melt or solvent spinning techniques. Reaction spinning involves the formation of filaments from reactive polymers or prepolymers and monomers that are further polymerized and crosslinked during the extrusion process or after the fiber or filament is formed.

Click chemistry refers to a collection of reactions capable of forming a highly reliable molecular connection in solution or bulk state. Click chemistry reactions may be highly selective, high yield reactions which should not interfere with one another as well as other reactions.

It would be desirable to make filaments useful in making surgical devices by extruding a mixture containing first and second precursors functionalized for crosslinking by click chemistry using a transition metal ion catalyst.

SUMMARY

A first aspect of the invention is a process comprising:

mixing first and second precursors each possessing a core and at least one functional group known to have click reactivity in a hopper; and extruding the first and second precursors through an extrusion die to produce a filament, wherein the polymerization of the first and second precursors is catalyzed by transition metal ions.

In embodiments, the functional group of the first precursor is an azide group and the functional group of the second precursor is an alkyne group.

In embodiments, the first precursor and optionally the second precursor comprises a polyol core.

In embodiments, the polyol is selected from the group consisting of polyethers, polyesters, polyether-esters, polyalkanols, and combinations thereof.

In embodiments, the polyol comprises a polyether selected from the group consisting of polyethylene glycol, polypropylene glycol, polybutylene glycol, polytetramethylene glycol, polyhexamethylene glycol, cyclodextrin-polyethylene glycols, polyacetals, and combinations thereof.

In embodiments, the polyol comprises a polyester selected from the group consisting of trimethylene carbonate, ϵ-caprolactone, p-dioxanone, glycolide, lactide, 1,5-dioxepan-2-one, polybutylene adipate, polyethylene adipate, polyethylene terephthalate, and combinations thereof.

In embodiments, the polyol comprises a poly(ether-ester) block.

In embodiments, the transition metal ions are selected from the group consisting copper, zinc, iron, aluminum, magnesium, and alloys thereof.

For example, the transition metal ions are copper ions selected from copper sulfate, copper iodide, and combinations thereof.

In embodiments, the transition metal ions are leached from a metal surface.

In embodiments, the transition metal ions are coated on a surface as a chelating resin.

In embodiments, the transition metal ions are present on mixing blades of the hopper.

In embodiments, the transition metal ions are present on the extrusion die.

In embodiments, the transition metal ions are present in a cartridge coupled to the extrusion die.

In embodiments, the process of the invention further comprises the step of quenching the filament in a quench bath after extrusion.

In embodiments, the transition metal ions are present in the quench bath.

Another aspect of the invention is a filament obtained by the process above. In particular, an aspect of the invention is a filament obtained by:

mixing first and second precursors each possessing a core and at least one functional group known to have click reactivity in a hopper; and extruding the first and second precursors through an extrusion die to produce a filament, wherein the polymerization of the first and second precursors is catalyzed by transition metal ions.

Another aspect of the invention is a fiber comprising at least a filament as above.

Another aspect of the invention is a fiber comprising a filament extruded by crosslinking a mixture of a first precursor possessing at least one functional group with a second precursor possessing a functional group known to have click reactivity with the first functional group in the presence of a transition metal catalyst.

A method for forming cross-linked fibers includes mixing first and second precursors each possessing a core and at least one functional group known to have click reactivity in the presence of a transition metal ion in a hopper. The mixed precursors are then extruded through an extrusion die to produce a cross-linked filament. Polymerization of the first and second precursors is catalyzed by transition metal ions.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiments given below, serve to explain the principles of the disclosure.

DETAILED DESCRIPTION OF THE EMBODIMENTS

Figure 1:
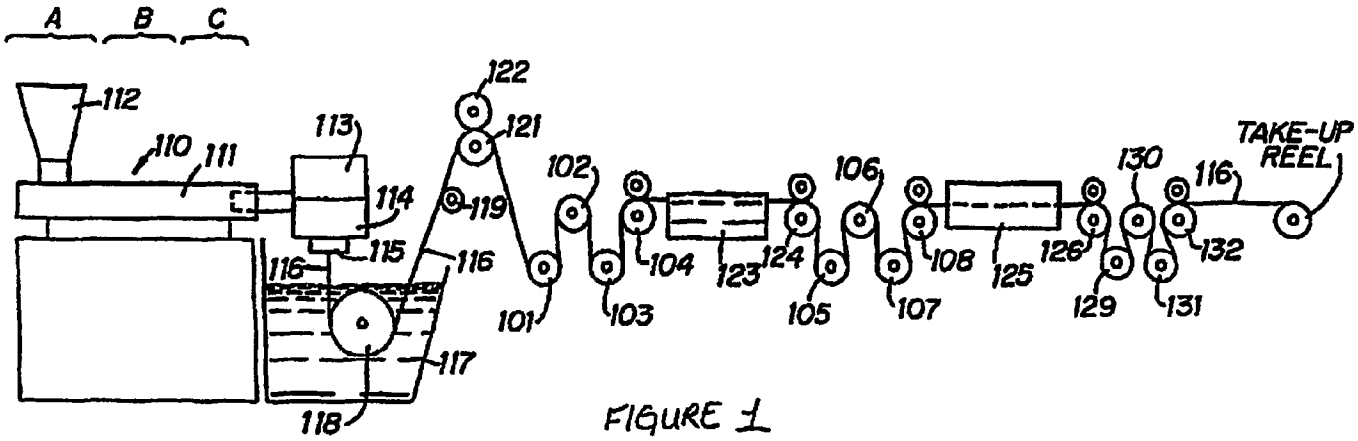
FIG. 1 is a schematic illustration of an apparatus which is suitable for carrying out a fiber manufacturing process in accordance with the present disclosure.

Crosslinked fibers in accordance with the present disclosure are prepared by spinning or extruding a mixture of first and second precursors each having at least at least one functional group known to have click reactivity in the presence of a transition metal ion catalyst. The first and second precursors may each possess a core functionalized with a reactive member. In the present application, unless otherwise specified, the expressions 'functional group", "functional unit", "functionality", "functional group known to have click reactivity" and "reactive member" in relation to the first and second precursors are used interchangeably to designate a functional group known to have click reactivity.

Suitable components for use as the core(s) include, but are not limited to, monomers, oligomers, macromers, polymers, and the like. The reactive member(s) may be, for example, an amine, sulfate, thiol, hydroxyl, azide, alkyne, alkene, and carboxyl group. In embodiments, the first precursor possesses at least one azide group and the second precursor possesses at least one alkyne group.

The click chemistry reaction of the present disclosure includes first and second precursors each having terminal and/or side chain functionality. The first and second precursors are functionalized by converting an attached functional unit on the precursor thereby providing site specific functional materials, site specific functional materials comprising additional functionality, or chain extended functional materials. Optionally, a linker may or may not be present for linking a functional group to the precursor. The first precursor, the second precursor, or both may have at least one reactive member. In embodiments, the precursors may have from about 2 to about 50 reactive members. These reactive members may form arms extending from the core(s). Such cores may thus be linear, branched, star-shaped, dendrimeric, and the like.

Examples of the types of reactions that are known to have click reactivity include cycloaddition reactions. Cycloaddition reactions can be used to form the fibers of the present disclosure. These reactions represent highly specific reactant pairs that have a chemoselective nature, meaning that they mainly react with each other and not other functional groups. One example of a cycloaddition reaction is the Huisgen 1,3-dipolar cycloaddition of a dipolarophile with a 1,3 dipolar component that produce five membered (hertero)cycles. Examples of dipolarophiles are alkenes, alkynes, and molecules that possess related heteroatom functional groups, such as carbonyls and nitriles. Specifically, another example is the 2+3 cycloaddition of alkyl azides and acetylenes. Other cycloaddition reactions include Diels-Alder reactions of a conjugated diene and a dienophile (such as an alkyne or alkene).

Other examples of the types of reactions that are known to have click reactivity include a hydrosilation reaction of H—Si and simple non-activated vinyl compounds, urethane formation from alcohols and isocyanates, Menshutkin reactions of tertiary amines with alkyl iodides or alkyl trifluoromethanesulfonates, Michael additions, e.g., the very efficient maleimide-thiol reaction, atom transfer radical addition reactions between —SO2Cl and an olefin ($R^1$, $R^2$—C═C—$R^3$, $R^4$), metathesis, Staudinger reaction of phosphines with alkyl azides, oxidative coupling of thiols, many of the procedures already used in dendrimer synthesis, especially in a convergent approach, which require high selectivity and rates, nucleophilic substitution, especially of small strained rings like epoxy and aziridine compounds, carbonyl chemistry like formation of ureas, and addition reactions to carbon-carbon double bonds like dihydroxylation. Therefore, attached functionality may be chosen from acetylene bond, an azido-group, a nitrile group, acetylenic, amino group, phosphino group. The click chemistry reaction may results in the addition of a functional group selected from amino, primary amino, hydroxyl, sulfonate, benzotriazole, bromide, chloride, chloroformate, trimethylsilane, phosphonium bromide or bio-responsive functional group including polypeptides, proteins and nucleic acids, to the polymer.

The core of the first and second precursors may be any suitable biocompatible material. Thus, the fibers may be prepared from any first and second precursors known to form biocompatible polymers. In embodiments, the first and second precursors may be different materials, thus forming copolymer filaments. The fibers may be formed from a natural material or a synthetic material. The material from which the fibers are formed may be bioabsorbable or non-bioabsorbable. It should of course be understood that any combination of natural, synthetic, bioabsorbable and non-bioabsorbable materials may be used to form the fibers.

In embodiments, suitable cores for use as the first precursor, the second precursor, or both, may be prepared from a polyol, a polyamine, or a polythiol. In embodiments a polyol may be used to form a core. Examples of such polyols include, in embodiments, polyethers, polyesters, polyether-esters, polyalkanols, combinations thereof, and the like.

Suitable polyethers which may be utilized in forming the core of the first precursor and/or the second precursor are within the purview of those skilled in the art and include, for example, polyethylene glycol, polypropylene glycol, polybutylene glycol, polytetramethylene glycol, polyhexamethylene glycol, copolymers thereof such as cyclodextrin-polyethylene glycols, polyacetals, and combinations thereof. In embodiments a suitable polyether may include polyethylene glycol.

Suitable polyesters which may be utilized in forming the core of the first precursor and/or the second precursor are within the purview of those skilled in the art and include, for example, trimethylene carbonate, ϵ-caprolactone, p-dioxanone, glycolide, lactide, 1,5-dioxepan-2-one, polybutylene adipate, polyethylene adipate, polyethylene terephthalate, and combinations thereof.

In addition, as noted above, the first precursor and/or the second precursor may include a poly(ether-ester) block. Any suitable poly(ether-ester) block within the purview of those skilled in the art may be utilized. These macromers may include an aliphatic diacid, aromatic diacid, alicyclic diacid, or combinations thereof, linking two dihydroxy compounds (sometimes referred to herein as a "poly(ether-ester) macromer"). Up to ten repeats of the poly(ether-ester) macromer may be present.

Suitable diacids which may be utilized in forming the poly(ether-ester) macromer include, for example, diacids having from about 2 to about 10 carbon atoms. Suitable diacids include, but are not limited to, sebacic acid, azelaic acid, suberic acid, pimelic acid, adipic acid, glutaric acid, succinic acid, malonic acid, oxalic acid, terephthalic acid, cyclohexane dicarboxylic acid, and combinations thereof.

Suitable dihydroxy compounds which may be utilized in forming the poly(ether-ester) macromer include, for example, polyols including polyalkylene oxides, polyvinyl alcohols, polycaprolactone diols, and the like. In some embodiments, the dihydroxy compounds can be a polyalkylene oxide such as polyethylene oxide ("PEO"), polypropylene oxide ("PPO"), block or random copolymers of polyethylene oxide (PEO) and polypropylene oxide (PPO), and combinations thereof.

In one embodiment, a polyethylene glycol ("PEG") may be utilized as the dihydroxy compound. It may be desirable to utilize a PEG with a molecular weight of from about 200 g/mol to about 10000 g/mol, in embodiments from about 400 g/mol to about 900 g/mol. Suitable PEGs include those commercially available from a variety of sources under the designations PEG 200, PEG 400, PEG 600 and PEG 900.

Any method may be used to form the poly(ether-ester) macromer. In some embodiments, the poly(ether-ester) macromer may be formed by combining adipoyl chloride with a PEG such as PEG 600 and pyridine in a suitable solvent, such as tetrahydrofuran (THF). The solution may be held at a suitable temperature, from about −70° C. to about 25° C., for a period of time of from about 4 hours to about 18 hours, after which the reaction mixture may be filtered to remove the precipitated pyridine hydrochloride by-product and the resulting poly(ether-ester) macromer, here a PEG/adipate compound. The resulting poly(ether-ester) macromer may be obtained from the solution by the addition of an ether or petroleum ether, and collected by suitable means which can include filtration. Other methods suitable for producing such macromers are within the purview of those skilled in the art.

In embodiments, components utilized in forming poly (ether-esters) may be functionalized and reacted to form poly (ether-ester-urethanes), poly(ether-ester-ureas), and the like.

Other examples of suitable poly(ether-ester) blocks which may be utilized include, but are not limited to, polyethylene glycol-polycaprolactone, polyethylene glycol-polylactide, polyethylene glycol-polyglycolide, and various combinations of the individual polyethers and polyesters described herein. Additional examples of suitable poly(ether-ester) blocks include those disclosed in U.S. Pat. No. 5,578,662 and U.S. Patent Application No. 2003/0135238, the entire disclosures of each of which are incorporated by reference herein.

In embodiments, the resulting poly(ether-ester) macromer may be of the following formula:

$$HO—(X\text{-}A)_y\text{-}X—OH \quad (I)$$

wherein A is a group derived from an aliphatic, aromatic, or alicyclic diacid; X can be the same or different at each occurrence and may include a group derived from a dihydroxy compound; and y may be from about 1 to about 10. In some embodiments, the A group can be derived from adipic acid, and X can be derived from a polyethylene glycol having a molecular weight of from about 200 g/mol to about 1000 g/mol, in embodiments from about 400 g/mol to about 800 g/mol, in embodiments about 600 g/mol.

The molecular weight and viscosity of these compounds may depend on a number of factors such as the particular diacid used, the particular dihydroxy compound used, and the number of repeat units present. Generally, the viscosity of these compounds may be from about 300 to about 10,000 cP at 25° C. and a shear rate of 20.25 $sec^{-1}$.

In other embodiments, polyrotaxanes may be utilized as the core of the first precursor, the second precursor, or both. Polyrotaxane materials include cyclic molecules, linear molecules threaded through the cyclic molecules, and optionally bulky end groups on the linear molecules to prevent the loss of the cyclic molecules by dethreading. With respect to rotaxanes, "linear molecules" refers to any suitable molecules, whether branched or unbranched, that are capable of threading the cyclic molecules to form the rotaxane material. The linear molecules are generally in the form of chains that are unbranched. Branching of the linear molecules may occur, but not to the extent that the branching significantly interferes with the formation of the rotaxane material.

Examples of suitable polyrotaxanes include those created by linear polymers such as poly(ethylene oxide) (PEO) penetrating the inner cavity of cyclodextrins (CDs) to form inclusion complexes with a necklace-like supramolecular structure.

In addition to the polyols described above, in embodiments a polyamine and/or a polythiol may be used to form a core of first and second precursors herein.

In embodiments, the polyol, such as a polyether, polyester, or polyether-ester as described above, may be a branched polyol. Such a polyol may have a central core from which from about 3 to about 12 arms may extend, with hydroxyl groups at the free terminal of each arm. Thus, for example, a 4-armed polyol may have the following structure:

(II)

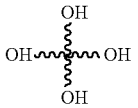

In embodiments, the polyol, such as a polyether, polyester, or polyether-ester as described above, may be endcapped with functional groups. Methods for endcapping the polyol to provide a reactive end group are within the purview of those skilled in the art.

In embodiments, the first precursor may be endcapped with at least two azide groups and the second precursor may be endcapped with at least two alkyne groups. Where one of the precursors is endcapped with two groups, the other precursor may be endcapped with 3 or more groups.

An example of a 4-armed alkyne includes an alkyne of the following formula:

(III)

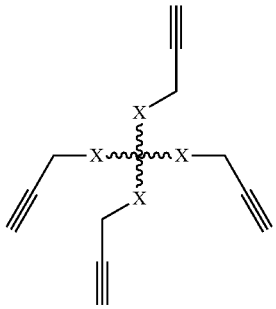

wherein X may be O, NH, S, $SO_2$, combinations thereof, and the like.

The above alkyne of formula III may be reacted with a polyazide. Suitable azides include, for example, (IV)

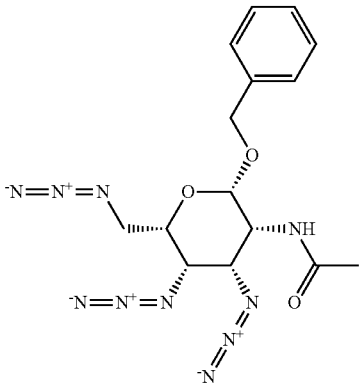

N((2S,3R,4S,5S,6S)-4,5diazido-6-(azidomethyl)-2-(benzyloxy)tetrahydro-2H-pyran-3-yl)acetamide (V)

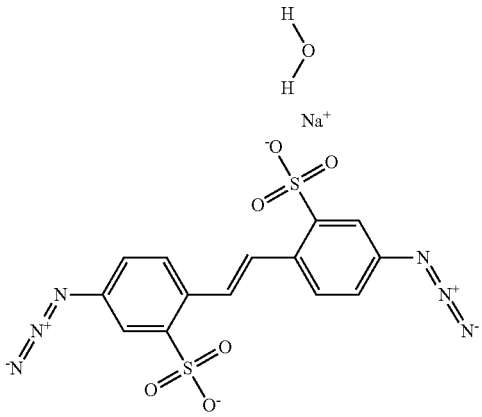

4,4′-Diazido-2,2′-stilbenedisulfonic acid disodium salt hydrate (VI)

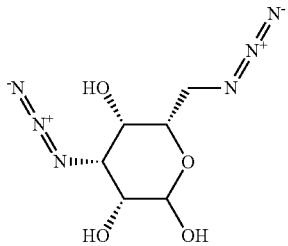

(3R,4R,5S,6S)-4-azido-6-(azidomethyl)tetrahydro-2H-pyran-2,3,5-triol

-continued (VII)

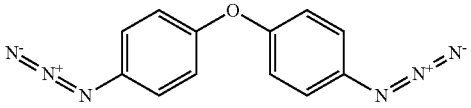

4,4′-oxybis(azidobenzene)

(VIII)

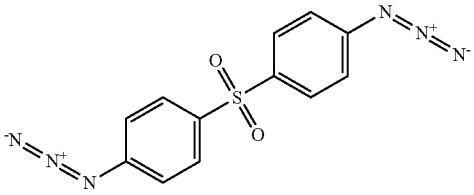

4,4′-sulfonylbis(azidobenzene)

(IX)

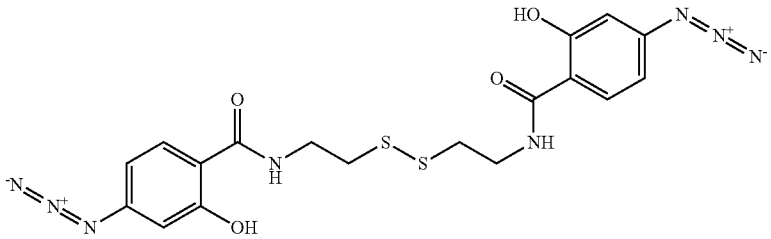

bis[2-(4-azidosalicylamido)ethyl]disulfide (X)

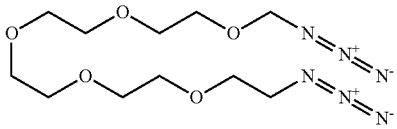

1,17-diazido-3,6,9,12,15-pentaoxaheptadecane (XI)

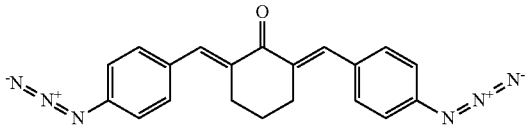

(2E,6E)-2,6-bis(4-azidobenzylidene)cyclohexanone (XII)

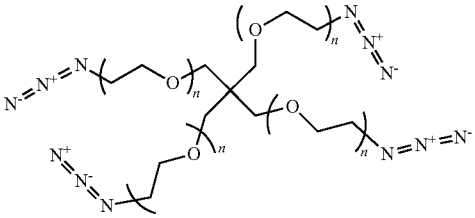

tetraazido-pentaerythritol ethoxylate heptakis-6-azido-6-deoxy-beta-cyclodextrin, combinations thereof, and the like. The alkyne of formula III may be reacted with an azide utilizing a copper catalyst to produce a compound of the present disclosure having the following structure:

(XIII)

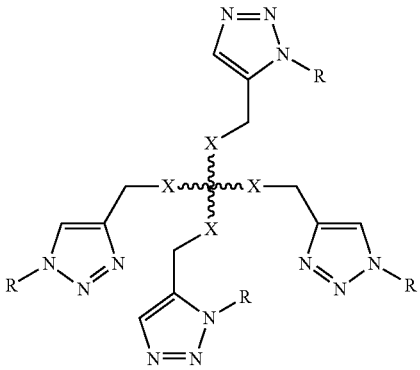

wherein X is as defined above for formula III and R may be the remainder of the polyazide component, i.e., a fragment of a polyazide molecule wherein the azide group is linked to the rest of the molecule through an alkyl group, alicyclic group, aromatic group, combinations thereof, and the like.

In other embodiments, a branched alkyne may be of the following formula (XIV)

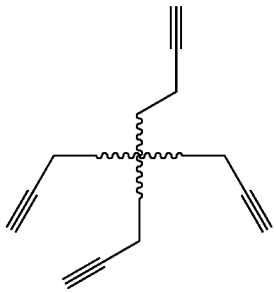

Other branched alkynes include, for example,
(XV)
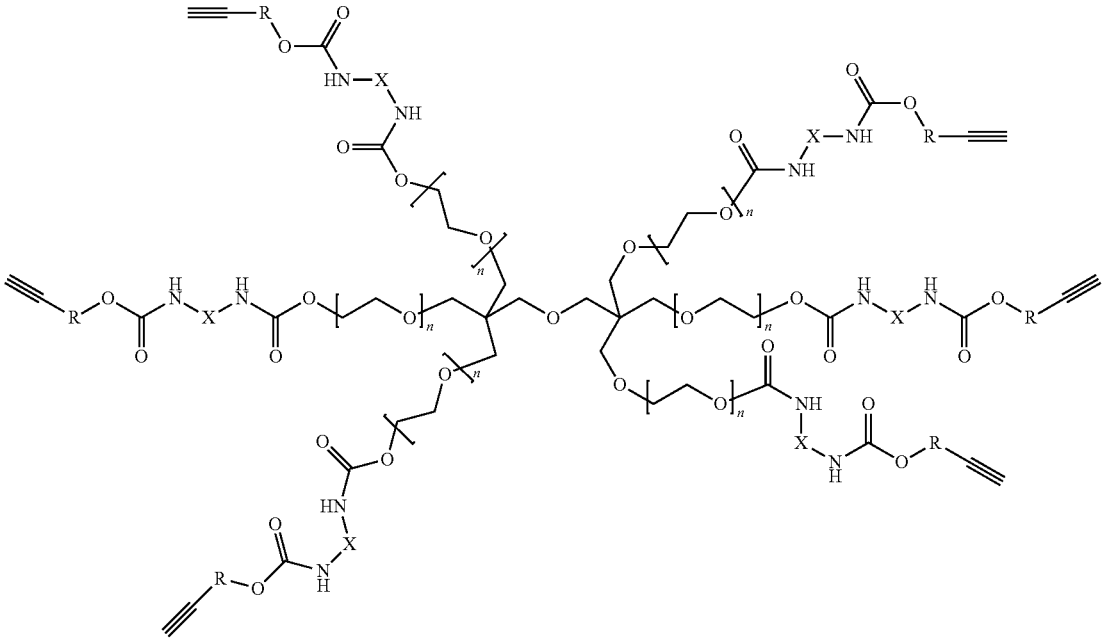
wherein X may be aliphatic, alicyclic, aromatic, or a combination thereof, and
wherein R may be aliphatic, alicyclic, aromatic, or a combination thereof;
(XVI)
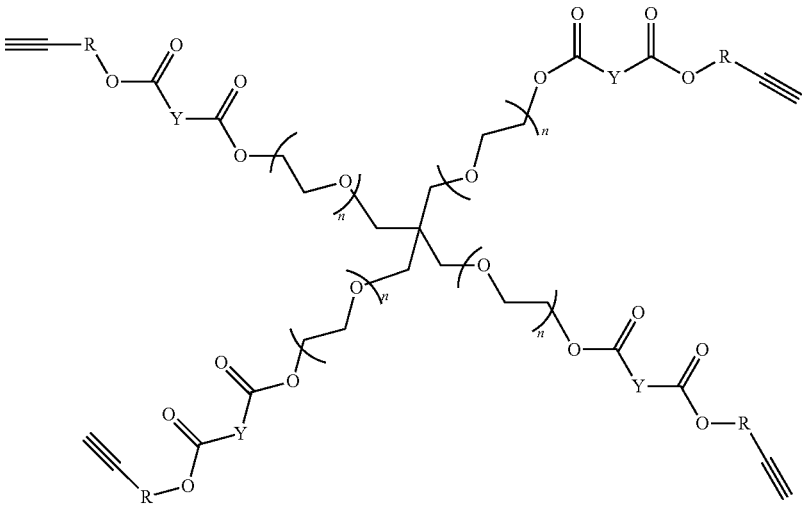

wherein Y may be aliphatic, alicyclic, aromatic, or a combination thereof, and wherein R may be aliphatic, alicyclic, aromatic, or a combination thereof; and (XVII)

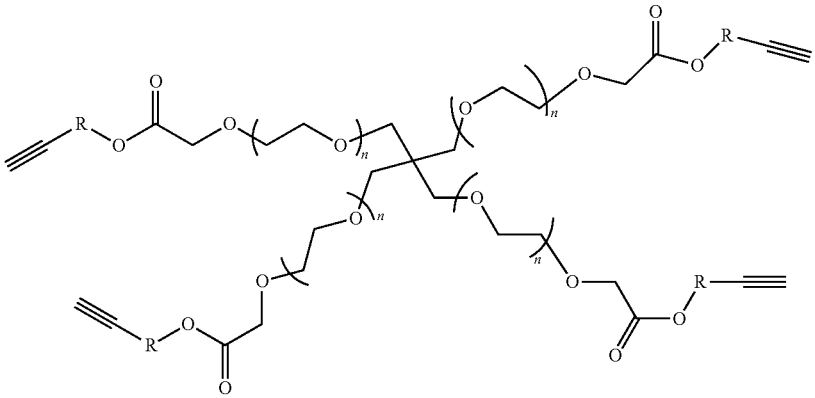

wherein R may be aliphatic, alicyclic, aromatic, or a combination thereof, and n in any of the formulas above may be a number from about 0 to about 112, in embodiments from about 1 to about 100, in other embodiments from about 3 to about 56.

A branched azide may have from about 3 to about 12 arms, in embodiments from about 4 to about 6 arms. An exemplary 4-armed branched azide may have the following generic formula (XVIII)

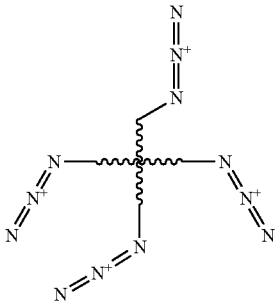

The alkyne of formula V and the azide of formula VI may then be reacted in the presence of a copper catalyst to produce the following compound:

(XIX)

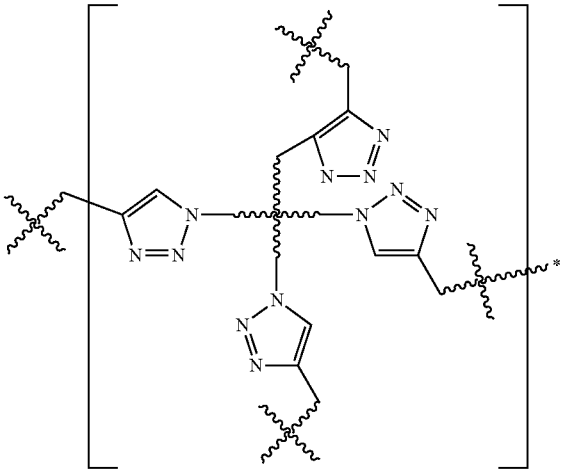

In preparing fibers in accordance with the present disclosure, the first and second precursors may be commercially available pre-functionalized cores or may be synthesized. For example, pendant chlorides on a core may be converted into azides by reaction with sodium azide.

The core of the first and second precursor can be provided with click reactive members using any variety of suitable chemical processes.

For example, the monomers from which the core is made can be functionalized so that the reactive members appear along the length of the core. In such embodiments, monomers can be initially functionalized with a group such as a halogen to provide a reactive site at which the desired first click reactive member can be attached after polymerization. Thus, for example, a cyclic lactone (e.g., glycolide, lactide, caprolactone, etc.) can be halogenated and then polymerized using known techniques for ring opening polymerization. Once polymerized, the halogenated sites along the resulting polyester chain can be functionalized with a click reactive member, for example, by converting pendant chlorides on the core into azides by reaction with sodium azide. See, R. Riva et al., *Polymer* 49 pages 2023-2028 (2008) for a description of such reaction schemes. Other methods for functionalizing lactones are described in Jérôme et al., *Advanced Drug Delivery Reviews,* 60, pages 1056-1076 (2008) and Shi et al., *Biomaterials,* 29, pages 1118-1126 (2008). The entire disclosure of each of these three articles is incorporated herein by this reference. Alternatively, the polymer or copolymer backbone may be halogenated using methods similar to those described by Nottelet et al., *Biomaterials,* 27, pages 4948-4954 (2006). Once halogenated, the backbone can be functionalized with a click reactive functionality by reacting it with a hydroxyacid under condition described by Shi et al. *Biomaterials,* 29, pages 1118-1126 (2008) followed by reaction with sodium azide. The halogen may also be converted directly to the alkyne by reacting it with an alcoholic alkyne such as propargyl alcohol.

Where one of the precursors includes a core that is an amino-containing material (e.g., collagen, polypeptide, glycosaminoglycan, etc.), the core of the second precursor can be functionalized by using any method known to those skilled in the art to provide pendant portions of the core with moieties which are capable of covalently bonding with the amino groups on the first precursor. Examples of such pendant moieties include aldehyde groups, sulfone groups, vinylsulfone groups, isocyanate groups, acid anhydride groups, epoxide groups, aziridine groups and episulfide groups. In addition, electrophilic groups such as $—CO_2N(COCH_2)_2$, $—CO_2N(COCH_2)_2$, $—CO_2H$, —CHO, $—CHOCH_2$, —N═C═O, $—SO_2CH═CH_2$, $—N(COCH)_2$, —S—S—$(C_5H_4N)$ may also be added to pendant chains of the core to allow covalent bonding to occur with the any cores showing amino group on their chains. Other suitable functional groups which may be added to the core include groups of the following structures wherein X is Halogen and R is hydrogen or $C_1$ to $C_4$ alkyl:

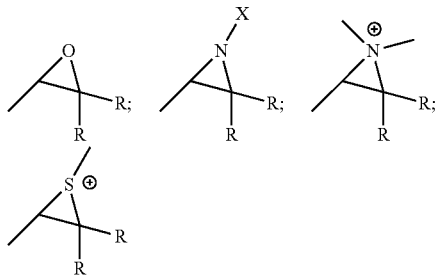

Those skilled in the art reading this disclosure will readily envision chemical reactions for activating other core materials to render them suitable for use as precursors in the presently described methods.

The first and second precursors may take the form of any solution, suspension, semi-solid, or solid material capable of allowing the two precursors to interact and crosslink. The first and second precursors may be in granular, pellet, or powder form, or alternatively, may be in a dilute solution. Suitable solvents which may be utilized to form a dilute solution include any biocompatible solvent within the purview of those skilled in the art which will not interfere with the reaction of the reactive members of the first and second precursors. Suitable solvents which may be utilized include, for example, polar solvents such as water, ethanol, triethylene glycol, dimethyl sulfoxide, glymes (such as diglyme, triglyme, tetraglyme, and the like), polyethylene glycols, methoxy-polyethylene glycols, dimethylformamide, dimethylacetamide, gamma-butyrolactone, n-methylpyrollidone, ketones such as methyl ethyl ketone, cyclohexanone, diethylene glycol momethyl ether acetate, diethylene glycol monobutyl ether acetate, diethylene glycol monomethyl ether, diethylene glycol monoethyl ether, diethylene glycol monobutyl ether, diethylene glycol monoisobutyl either, diisobutyl ketone, diacetone alcohol, ethyl amyl ketone, ethyl lactate, and the like. In other embodiments, solvents such as tetrahydrofuran, ethyl acetate, isopropyl acetate, butyl acetate, isopropanol, butanol, acetone, and the like, may be utilized. In embodiments, combinations of any of the foregoing solvents may be utilized to form a dilute solution. The amount of solvent used will depend on a number of factors, including the particular first precursor, second precursor, or combination thereof that are to be employed and the intended end use of the composition.

The first and second precursors may be placed in a hopper and mixed thoroughly to provide substantially uniform distribution of the first precursor among the second precursor. The first and second precursors may be mixed using any conventional technique, with or without heating. For example, a mechanical mixer, a static mixer, or combinations thereof, may be employed to assist in providing a substantially uniform distribution of first and second precursors. After mixing, the mixture is extruded or spun to form one or more filaments. A transition metal catalyst is introduced during the extrusion process to aid in polymerization of the first and second precursors into filaments. The transition metal catalyst may be copper, zinc, iron, aluminum, magnesium, and alloys thereof.

In embodiments, the use of copper catalysts, such as Cu(I) catalysts, may accelerate the process. Suitable copper catalyst which may be utilized include, but are not limited to, copper sulfate, copper iodide, copper (II) sulfate in combination with ascorbic acid, combinations thereof, and the like. In embodiments, the copper catalyst may include copper sulfate, in embodiments, $CuSO_4$, $5H_2O$.

The first and second precursors may be contacted with the transition metal ion catalyst at one or more points in the extrusion process. For example, the blades of the mixer in the extrusion hopper may be coated with or made from a material that contains the transition metal ion catalyst. As another example, prior to passing through the spinneret, a mixture of the first and second precursors may be caused to pass though a mesh or filter coated with or made from a material that contains a transition metal ion catalyst. As yet another example, the unhardened filament may be passed through a quench bath containing the transition metal ion catalyst to cross-link the first and second precursors. The use of a quench bath to cross-link the first and second precursors is particularly useful where the fiber is made from a hydrophilic polymer or in a solution or gel spinning process.

In embodiments, the transition metal ion catalyst may be present on one or more surfaces of the extrusion apparatus using a chelating matrix of the type used in immobilized metal affinity chromatography. For example, a suitable chelating matrix can be prepared by derivatization of hydroxyl groups with iminodiacetic acid (IDA), carboxymethyl aspartic acid (CM-Asp) and with tris(carboxymethyl) ethylenediamine (TED) on agarose beads, as well as silica gel functionalized with IDA. The preparation of such chelating matrices is disclosed in Le Dévédec et al., "Separation of chitosan oligomers by immobilized metal affinity chromatography," *J Chromatogr A.,* 2008 Jun. 20; 1194(2):165-71, the entire disclosure of which is incorporated herein by this reference.

The rate of cross-linking of the first and second precursors of the present disclosure may be tailored by controlling the concentration of the first precursor and the second precursor. Generally, a faster cross-linking time may be observed at a higher concentration of either the first or second precursors than the rate observed for the same components at a lower concentration. In embodiments, the ratio of first precursor reactive members to second precursor reactive members is from about 1:2 to about 1:1.

Figure 2:
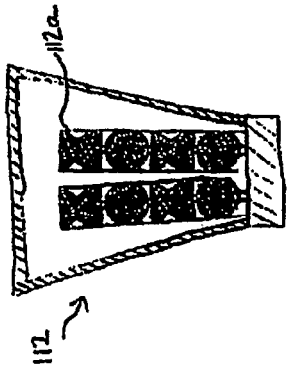
FIG. 2 is a cross-sectional view of one embodiment of the mixer having metal mixing blades in accordance with the present disclosure.
Figure 4:
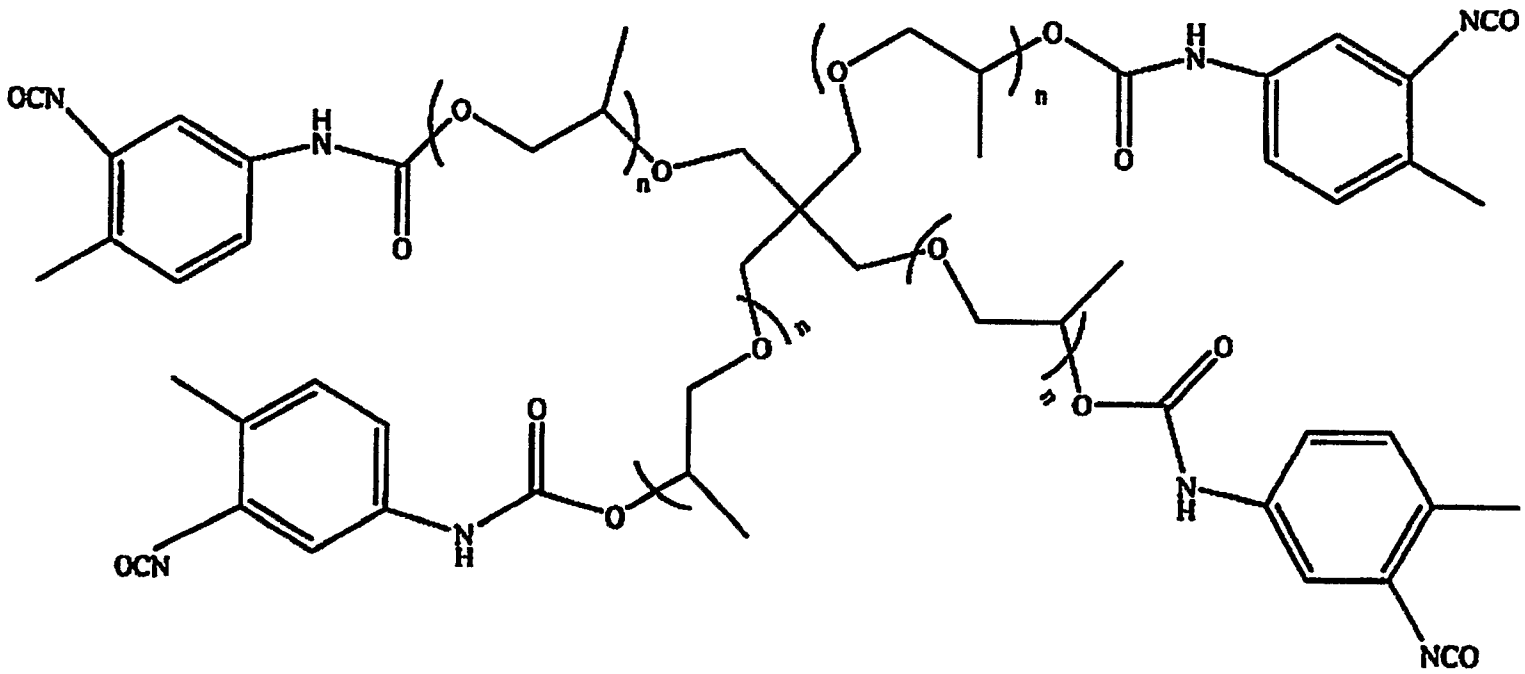
FIG. 4 is a depiction of a pentaerythritol adduct which may be utilized to form an acetylenic derivative for use in the present disclosure.
Figure 5:
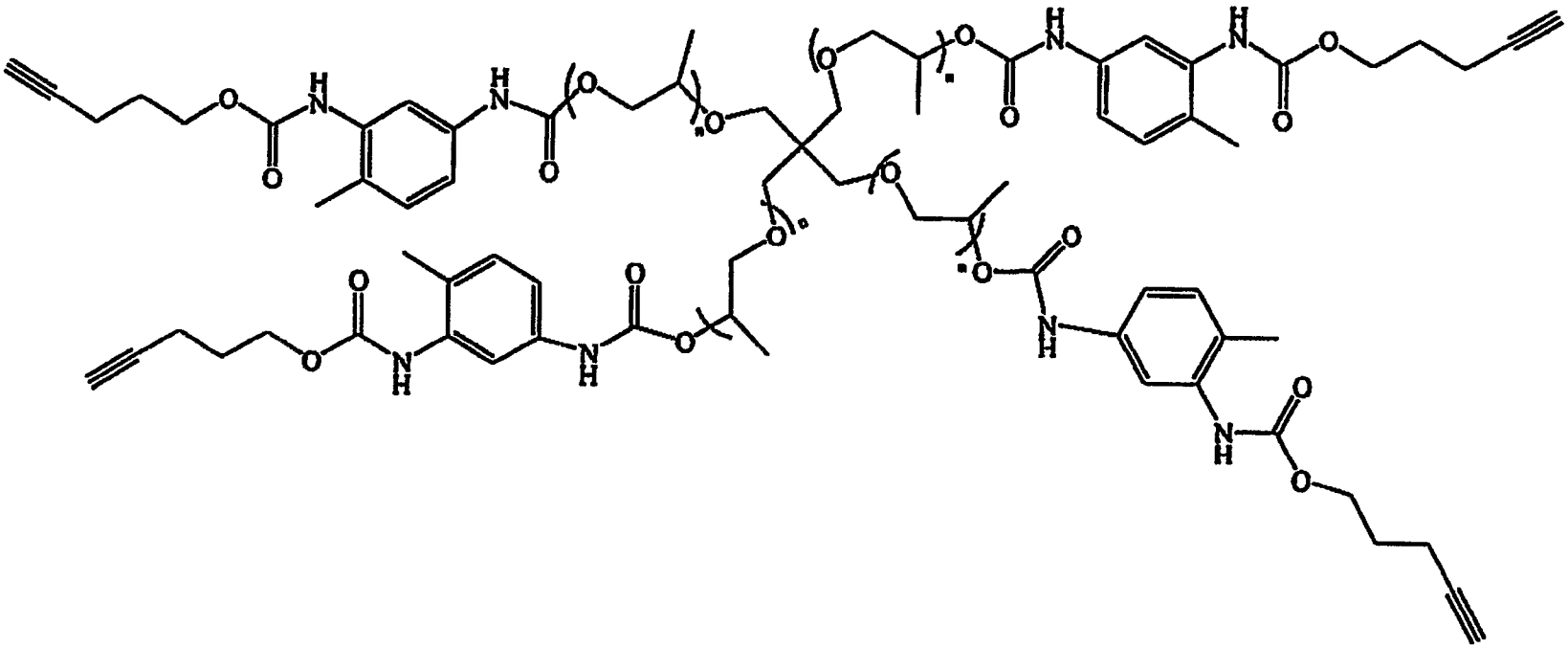
FIG. 5 is a depiction of an acetylenic derivative for use in the present disclosure.

FIG. 1 schematically illustrates an illustrative filament manufacturing operation in accordance with the disclosure. Extruder unit 110 is equipped with controls for regulating the temperature of barrel 111 in various zones thereof, e.g., progressively higher temperatures in three consecutive zones, A, B, and C along the length of the barrel. The first and second precursors to be spun into filaments are introduced to the extruder through hopper 112. Prior to or during placement in hopper 112, the first precursor is combined with the second precursor and mixed in a one-pot process. In embodiments, the mixing blades of the hopper, as illustrated in FIG. 2, carry a transition metal catalyst to aid in the polymerization of the first and second precursors. Transition metal ions may be leached from the surface of the mixing blades or may be coated with a metal chelating resin.

Figure 3:
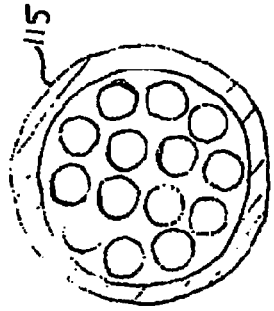
FIG. 3 is a front view of an embodiment of a filter coupled to an extrusion die in accordance with the principles of the present disclosure.

Motor-driven metering pump 113 delivers the melt extruded first and second precursor mixture at a constant rate and with high pressure to spin pack 114 and thereafter through an extrusion die or spinneret 115 possessing one or more orifices of desired diameter to provide a molten monofilament 116. In embodiments, the molten material may pass through a transition metal cartridge prior to entering the spinneret 115 or may pass through a transition metal spinneret as illustrated in FIG. 3.

The molten monofilament 116 then enters quench bath 117, e.g., containing water, where the monofilament solidifies. The distance monofilament 116 travels after emerging from spinneret 115 to the point where it enters quench bath 117, i.e., the air gap, can vary. If desired, a chimney (not shown), or shield, can be provided to isolate monofilament 116 from contact with air currents which might otherwise affect the cooling of the monofilament in an unpredictable manner. In general, barrel zone A of the extruder can be maintained at a temperature of from about 100° C. to 220° C., zone B at from about 160° C. to 230° C. and zone C at from about 170° C. to about 240° C. Additional temperature parameters include: metering pump block 113 at from about 170° C. to about 230° C., spin pack 114 at from about 170° C. to about 230° C., spinneret 115 at from about 170° C. to about 230° C. and quench bath at from about 10° C. to about 80° C.

Monofilament 116 is passed through quench bath 117 around driven roller 118 and over idle roller 119. Optionally, a wiper (not shown) may remove excess water from the monofilament as it is removed from quench bath 117.

In embodiments, the quench bath 117 may include the transition metal catalyst. The amount of catalyst needed may depend upon the starting materials utilized and their degree of functionalization. In embodiments, a suitable amount of catalyst may be from about 1% to about 10% by weight, in embodiments from about 2% to about 5% by weight.

In embodiments, a buffer salt may be combined with the above catalyst. Such buffers include, but are not limited to, acetates, citrates, malonates, tartarates, succinates, benzoates, ascorbates, phosphates, sulfates, nitrates, bicarbonates, carbonates, combinations thereof, and the like. In embodiments, ascorbates such as sodium ascorbate, calcium ascorbate, iron (II) ascorbate, combinations thereof, and the like, may be utilized with the catalyst.

On exiting the quench bath the monofilament is wrapped around a first godet 121 provided with nip roll 122 to prevent slippage which might otherwise result from the subsequent stretching operation; and subsequently wrapped around godets 101, 102, 103 and 104 or any other suitable godet arrangement. Monofilament 116 passing from godet 104 is stretched, e.g., with stretch ratios on the order of from about 3:1 to about 10:1 and preferably from about 4:1 to about 7:1, to effect its orientation and thereby increase its tensile strength.

In the stretching operation, monofilament 116 may be drawn through hot water (or other suitable liquid medium) draw bath 123 by means of godets 124, 105, 106, 107 and 108 or any other suitable arrangement of godets which rotate at a higher speed than godet 104 to provide the desired stretch ratio. The temperature of hot water draw bath 123 is advantageously from about 30° C. to about 90° C. and preferably is from about 30° C. to about 50° C. In an alternative stretching operation, generally preferred for smaller sutures sizes, e.g., sizes 3/0 to 8/0, monofilament 116 may be drawn by godets 124, 105, 106, 107, and 108 or any other suitable godet arrangement through hot air convection oven chamber 123 at a temperature of from about 30° C. to about 140° C., and preferably from about 50° C. to about 130° C. to provide the desired amount of stretch.

Following the stretching operation, monofilament 116 optionally may be subjected to an on-line annealing and/or additional stretching without shrinkage or relaxation with shrinkage operation as a result of which the monofilament shrinks. In the process of FIG. 1, on-line annealing with or without relaxation when desired is accomplished by driving monofilament 116 by godets 126, 129, 130, 131, and 132 or any other suitable godet arrangement through second hot air oven chamber 125 at a temperature of from about 40° C. to about 150° C., and preferably from about 60° C. to about 130° C. During the relaxation process, at these temperatures, monofilament 116 will generally recover to within about 80 to about 97 percent, and preferably to within about 95 percent, of its pre-annealed length to provide the finished suture. For relaxation, the third godet rotates at a slower speed than the second godet thus relieving tension on the filament.

Annealing of the filaments also may be accomplished without shrinkage of the suture. In carrying out the annealing operation, the desired length of suture may be wound around a creel and the creel placed in a heating cabinet maintained at the desired temperature, e.g. about 60° C. to about 130° C. After a suitable period of residency in the heating cabinet, e.g., about 18 hours or so, the suture will have undergone essentially no shrinkage. The creel may be rotated within the heating cabinet in order to insure uniform heating of the monofilament or the cabinet may be of the circulating hot air type in which case uniform heating of the monofilament will be achieved without the need to rotate the creel. Thereafter, the creel with its annealed suture is removed from the heating cabinet and when returned to room temperature, the filament is removed from the creel, conveniently by cutting the wound monofilament at opposite ends of the creel. The annealed filaments are then ready to be packaged and sterilized or formed into other surgical devices.

In embodiments, cross-linked fibers from chitin or chitin derivative cores that have been functionalized with first and second precursors each having at least at least one functional group known to have click reactivity in the presence of a transition metal ion catalyst can be produced according to the present disclosure by spinning from anisotropic solution. Suitable methods for solution spinning chitin or chitin derivative fibers are generally disclosed in European Patent Nos. EP0328050A2 and EP0077098A2, the entire disclosures of which are incorporated herein by this reference. Such fibers can have tensile properties which typically fall between 4-8 g/d tenacity and 150-250 g/d initial modulus.

High strength cross-linked chitosan fibers can be prepared by spinning an aniostropic solution of appropriately functionalized chitosan or a derivative of chitin or chitosan through an inert gas and into a coagulating bath, removing the as-spun fiber and treating it with alkali to remove N-acetyl, O-acetyl or other pendant groups at the 2, 3 and 6 carbon positions of the glucosamine repeating unit. Treatment of fibers is by immersion of the fibers into a solution of NaOH. With fine denier fibers, e.g., 4-5 dpf., a 5 minute immersion at 70° C. in a 50% wt. solution of NaOH is satisfactory. A 2-3 hr. exposure at 80° C. in a 30% wt. solution is useful with chitosan acetate formate fiber. With chitosan acetate, temperatures in the range of 80° to 116° C. at NaOH concentration of 30% have been found useful with the higher temperatures requiring less time for completion of the reaction. Severe treatments are generally to be avoided since they may cause excessive interfilament fusion and a product of inferior quality. Conversion of the starting fiber to a chitosan fiber is confirmed if the chitosan fiber is readily soluble in dilute (3-20% wt.) acetic acid.

Figure 6:
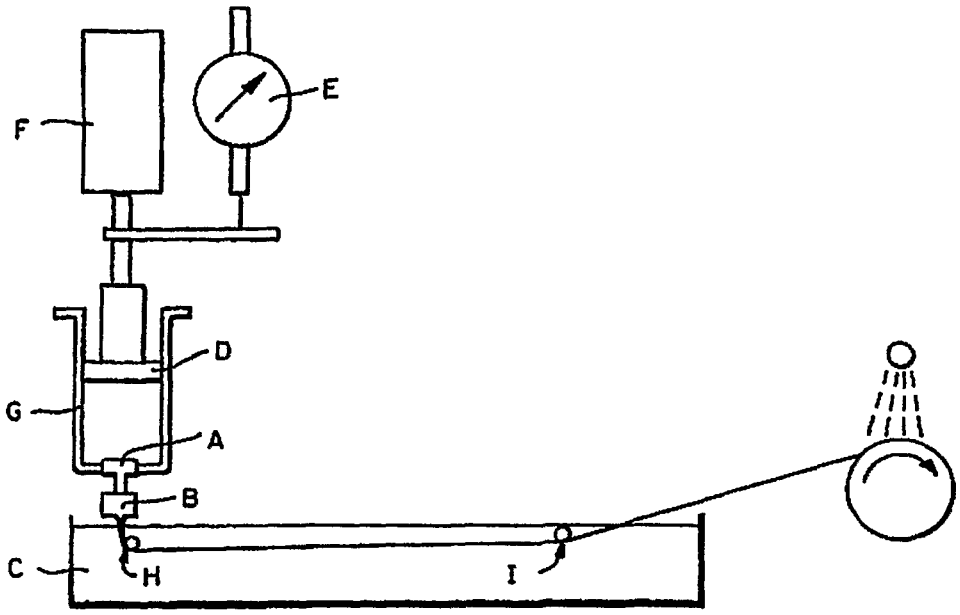
FIGS. 6 and 7 schematically illustrate apparatus suitable for carrying out an alternate fiber manufacturing process in accordance with the present disclosure.

In using the apparatus of FIG. 6 an anisotropic solution of chitin or a chitin derivative is placed in spin cell (G). A piston (D) activated by hydraulic press (F) and associated with piston travel indicator (E) is positioned over the surface of the solution, excess air is expelled from the top of the cell and the cell is sealed. The spin cell is fitted at the bottom with the following screens (A) for solution filtration: four to six 325-mesh screens. The filtered solution is then passed into a spinneret pack (B) containing two or three 325-mesh screens. Solutions are extruded through an air gap at a controlled rate into a static bath (C) using a metering pump to supply pressure at piston (D). The fiber is passed around a pin (H), pulled through the bath, passed under a second pin (I) and wound onto a bobbin. The air gap between the spinneret face and the coagulation bath is typically 0.6 to 2.0 cm. The coagulation bath temperature is generally held below 100° C.

Figure 7:
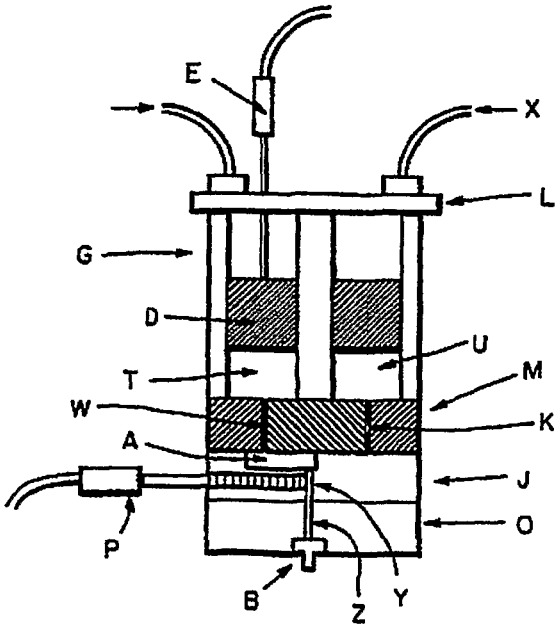

In using the apparatus of FIG. 7, filter plate (J) is replaced by mixing plate (R). Polymer dope is placed in cylinder bore (T) and then piston (D) and cap plate (L) is fitted to the spin cell (G). A driver fluid (e.g. water) is pumped into the upper part of bore (T) through feed line (F). The piston (D) is displaced by the driver fluid, thereby pushing the polymer dope through passages (W), (S) in mixing plate (R) and then through passage (K) in distribution plate (M) into second cylinder bore (U). This process is then reversed by pumping fluid through feed line (X). The aforementioned forward and reverse process is repeated several times to effect a mixing of the polymer dope. Component (E) acts to sense the position of cylinder (D).

After mixing is complete (about 30 cycles), mixing plate (R) is replaced by filter plate (J) and polymer dope is extruded from bore (T) through passage (W), through filter pack (A) containing 2 Dutch Twill Weave 165×800 mesh screens, through passage (Y) in filter plate (J) and passage (Z) in spinneret mounting plate (O) and out of spin cell (G) through spinneret (B). The extruded dope is spun into a bath and taken up as described for FIG. 7. Pressure of the polymer dope during spinning is measured by pressure transducer (P).

As noted previously, the first and second precursors may be contacted with the transition metal ion catalyst at one or more points in the extrusion process. For example, screens (A) can coated with or made from a material that contains a transition metal ion catalyst. As another example, mixing plate (R) may be coated with or made from a material that contains the transition metal ion catalyst. As yet another example, the filament may be passed through static bath (C) containing the transition metal ion catalyst in solution to cross-link the first and second precursors.

In other embodiments, cross-linked fibers from collagen or collagen derivative cores that have been functionalized with click reactive members can be produced according to the present disclosure by gel spinning. Suitable methods for gel spinning collagen fibers in general are disclosed in U.S. Pat. Nos. 5,562,946 and 5,911,942, the entire disclosures of which are incorporated herein by this reference.

Figure 8:
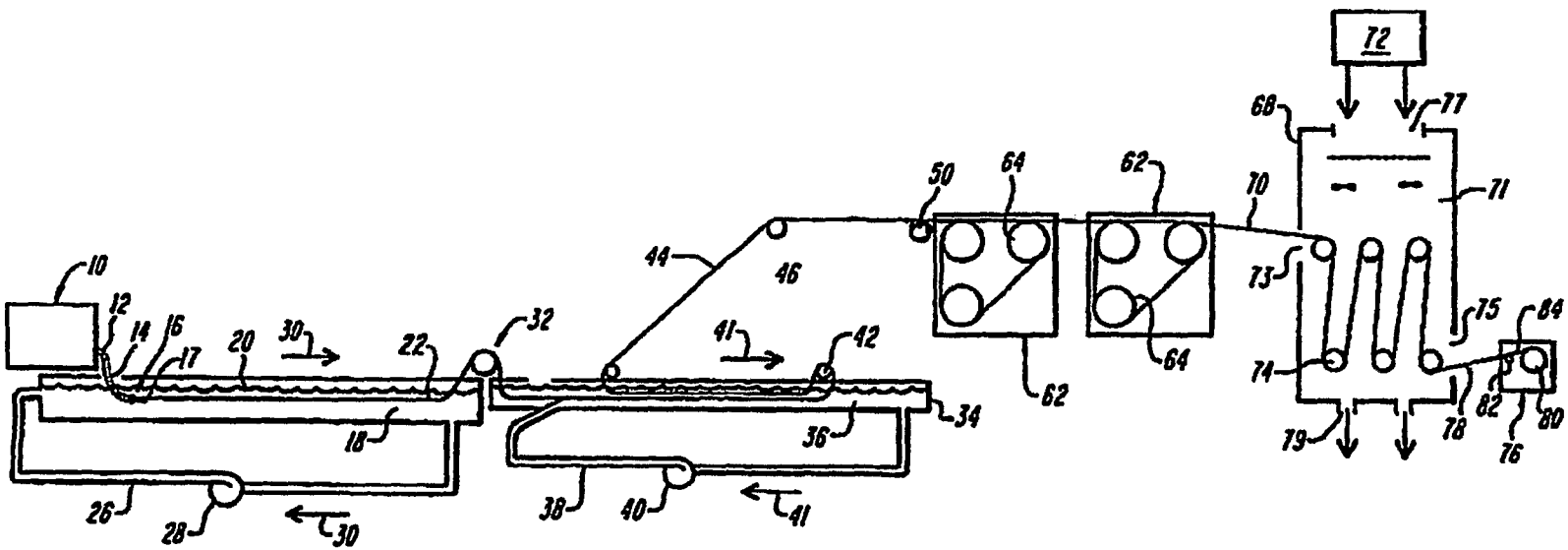
FIG. 8 schematically illustrate another apparatus suitable for carrying out a fiber manufacturing process in accordance with the present disclosure.

In an illustrative apparatus for gel spinning such fibers shown in FIG. 8, collagen reservoir chamber 10 holds a liquid collagen solution. In one embodiment, a suitable chamber is a stainless steel syringe. Reservoir tube 12 is attached to collagen reservoir chamber 10 for directing collagen solution from collagen reservoir chamber 10 through infusion pump 14 to spinneret 16. Infusion pump 14 is capable of raising the pressure of the collagen material such that it can be extruded through spinneret nozzle 17 of spinneret 16. In embodiments, a positive displacement metering pump is used. Spinneret 16 can be single bore or multiple bore to produce monofilament or multifilament fibers respectively. The spinneret bores can be of various diameters or have tapered profiles to form fibers of different sizes and tensile strengths. Co-component fibers can be produced with other specialized spinnerets as are known in the art. In one embodiment, spinneret nozzle 17 has diameters in the range of between about 100 and 1,000 microns.

Coagulation bath 18 has a coagulation solution 20 that can cause the liquid collagen to form a collagen gel, such as a 0.75% alkaline alginic acid in a boric acid buffer or sugar solutions or polyethylene glycol solution which also has hydrophilic properties. The opening of spinneret is immersed in a flowing coagulation solution 20. Coagulation bath 18 is suitably sized for allowing extrusion of fiber from spinneret 16 through coagulation solution 20 while having a sufficient residency time for collagen gel fiber 22 to form. Coagulation bath 18 can be heated and instrumented for monitoring the relevant process variables, such as temperature, pH and velocity. Coagulation bath 18 allows collagen gel fiber 22 to be formed in a horizontal trough or in a tube or vertically in a tube. Coagulation bath 18 is configured to allow circulation of coagulation solution 20 through recirculating loop 26 by circulating pump 28. Coagulation bath flow can be in the same direction 30 of fiber travel. At the end of the coagulation bath 18, roller 32 is for directing fiber out of the coagulation bath. Roller 32 is motorized and can be activated to wind collagen gel fiber 22 and subsequently tow collagen gel fiber 22 at desired speeds.

Dehydrating bath 34 is adjacent to roller 32 and coagulation bath 18 and is configured to allow fiber 22 to be drawn into dehydrating bath 34 from roller 32. Dehydrating bath 34 holds dehydrating solution 36, such as 90% ethanol, which allows further dehydration and annealing of the fiber and promotes polymerization of the collagen to improve fiber strength. An example of another suitable dehydration solution composition is acetone. Dehydrating bath 34 is configured to allow variable circulation of dehydrating solution 36 through recirculating loop 38 by circulating pump 40 which can be adjusted directionally, such as direction 41 or in the opposite direction. Return rollers 42, which can be near each end of dehydrating bath 34, allow the fiber path to be lengthened by doubling back to make any number of multiple passes through dehydrating bath 34 to allow further dehydration and promote polymerization and/or cross-linking of the first and second precursors.

Partially dehydrated fiber 44 is wound around roller 46 to second roller 50 and then to stretching roller means 62, wherein the fiber can undergo a controlled deformation by being stretched between two groups of rollers 64 rotating at slightly different rates of speed. The speed of rotation of rollers 64 can be precisely controlled with digital microprocessors arranged in a closed feedback loop. The fibers are wrapped around each roller 64 several times to prevent fiber slippage relative to the roller surfaces. Roller 64 surfaces can be made of a polymer or a hardened metal resistant to corrosion. Roller 64 rotations can be adjusted individually to allow the fiber to be stretched beyond the elastic yield point to produce a longer fiber of reduced diameter. Stretching roller means 62 can operate under semi-dry or dry conditions and also under high moisture content atmosphere.

Drying cabinet 68 has opening 73 for receiving stretched fiber 70 from stretching rollers 62. Drying cabinet 68 has passage 71 through drying cabinet 68 for receiving warm, dry filtered air or a dry inert gas, such as dry nitrogen gas, from gas source 72 at a suitable temperature and humidity for drying stretched fiber 70. The air can be passed through air passage opening 77 into passage 71 and exiting from air passage opening 79. In embodiments, the temperature of the air is between about 35° C. and 39° C. The humidity is in the range of between 10 and 20 percent relative humidity. Drying cabinet 68 has a series of rollers 74 which allows stretched fiber 70 to remain in drying cabinet 68 while being rolled, thereby increasing the residence time of fiber 70 in drying cabinet 68. Drying cabinet rollers 74 are adjustable in distance between each other and to compensate for the fiber line speed. Drying cabinet rollers 74 can be driven at a surface roller speed that can be synchronized with that of stretching roller means 62. Drying cabinet 68 has a door to provide access to the rollers for threading the leader thread.

Take-up winder 76 is for receiving dried fiber 78 from exit 75 of drying cabinet 68. Take-up winder 76 has spool 80 for receiving dried fiber on a removable spindle bobbin. Take-up winder 76 has a slip clutch 82 to provide a constant fiber line tension and fiber line speed as the spooled fiber rotates radially around spool 80. Fiber spool 80 can wind the fiber level or by randomly winding with the take-up winder 76.

As noted previously, the first and second precursors may be contacted with the transition metal ion catalyst at one or more points in the extrusion process. For example, the filament may be passed through coagulation solution 20 and/or dehydrating bath 34 containing the transition metal ion catalyst in solution to cross-link the first and second precursors. As another example, any of the rollers around which the fiber passes may be coated with or made from a material that contains the transition metal ion catalyst.

Fibers formed in accordance with the present invention may be used for a variety of surgical and wound applications. The fibers, for example, may be used alone, such as for example, for closing wounds and incisions in the form of monofilament or multifilament sutures. Multifilament sutures may be constructed using any technique within the purview of those skilled in the art, such as spinning and braiding the fibers together. The fibers may also be used in combination with the other absorbable or non-absorbable fibers to form multifilament sutures or to form knitted, woven, or non-woven meshes or fabrics. A wide variety of surgical articles can be manufactured from the fibers of the present disclosure. These include but are not limited to sutures as discussed above, threads, rods, filaments, yarns, meshes, slings, patches, wound dressings, drug delivery devices, fasteners, and other implants and composite materials, such as pledgets, buttresses, adhesion barriers, and the like.

The fibers may further be used for delivery of a bioactive agent. Thus, in some embodiments, at least one bioactive agent may be combined with either the first precursor or the second precursor and/or may be separately applied to finished fiber. The agents may be freely admixed with the precursors (making sure not reactive with them) or may be tethered to the precursors through any variety of chemical bonds. In these embodiments, the present fibers can also serve as a vehicle for delivery of the bioactive agent. The term "bioactive agent", as used herein, is used in its broadest sense and includes any substance or mixture of substances that have clinical use. Consequently, bioactive agents may or may not have pharmacological activity per se, e.g., a dye, or fragrance. Alternatively a bioactive agent could be any agent which provides a therapeutic or prophylactic effect, a compound that affects or participates in tissue growth, cell growth, cell differentiation, an anti-adhesive compound, a compound that may be able to invoke a biological action such as an immune response, or could play any other role in one or more biological processes. It is envisioned that the bioactive agent may be applied to the present fiber in any suitable form of matter, e.g., films, powders, liquids, gels and the like.

Examples of classes of bioactive agents which may be utilized in accordance with the present disclosure include anti-adhesives, antimicrobials, analgesics, antipyretics, anesthetics, antiepileptics, antihistamines, anti-inflammatories, cardiovascular drugs, diagnostic agents, sympathomimetics, cholinomimetics, antimuscarinics, antispasmodics, hormones, growth factors, muscle relaxants, adrenergic neuron blockers, antineoplastics, immunogenic agents, immunosuppressants, gastrointestinal drugs, diuretics, steroids, lipids, lipopolysaccharides, polysaccharides, platelet activating drugs, clotting factors and enzymes. It is also intended that combinations of bioactive agents may be used.

Anti-adhesive agents can be used to prevent adhesions from forming between the implantable medical device and the surrounding tissues opposite the target tissue. Some examples of these agents include, but are not limited to hydrophilic polymers such as poly(vinyl pyrrolidone), carboxymethyl cellulose, hyaluronic acid, polyethylene oxide, poly vinyl alcohols, and combinations thereof.

Suitable antimicrobial agents which may be included as a bioactive agent of the present disclosure include triclosan, also known as 2,4,4'-trichloro-2'-hydroxydiphenyl ether, chlorhexidine and its salts, including chlorhexidine acetate, chlorhexidine gluconate, chlorhexidine hydrochloride, and chlorhexidine sulfate, silver and its salts, including silver acetate, silver benzoate, silver carbonate, silver citrate, silver iodate, silver iodide, silver lactate, silver laurate, silver nitrate, silver oxide, silver palmitate, silver protein, and silver sulfadiazine, polymyxin, tetracycline, aminoglycosides, such as tobramycin and gentamicin, rifampicin, bacitracin, neomycin, chloramphenicol, miconazole, quinolones such as oxolinic acid, norfloxacin, nalidixic acid, pefloxacin, enoxacin and ciprofloxacin, penicillins such as oxacillin and pipracil, nonoxynol 9, fusidic acid, cephalosporins, and combinations thereof. In addition, antimicrobial proteins and peptides such as bovine lactoferrin and lactoferricin B may be included as a bioactive agent in the bioactive coating of the present disclosure.

Other bioactive agents which may be included as a bioactive agent in accordance with the present disclosure include: local anesthetics; non-steroidal antifertility agents; parasympathomimetic agents; psychotherapeutic agents; tranquilizers; decongestants; sedative hypnotics; steroids; sulfonamides; sympathomimetic agents; vaccines; vitamins; antimalarials; anti-migraine agents; anti-parkinson agents such as L-dopa; anti-spasmodics; anticholinergic agents (e.g. oxybutynin); antitussives; bronchodilators; cardiovascular agents such as coronary vasodilators and nitroglycerin; alkaloids; analgesics; narcotics such as codeine, dihydrocodeinone, meperidine, morphine and the like; non-narcotics such as salicylates, aspirin, acetaminophen, d-propoxyphene and the like; opioid receptor antagonists, such as naltrexone and naloxone; anti-cancer agents; anti-convulsants; anti-emetics; antihistamines; anti-inflammatory agents such as hormonal agents, hydrocortisone, prednisolone, prednisone, non-hormonal agents, allopurinol, indomethacin, phenylbutazone and the like; prostaglandins and cytotoxic drugs; chemotherapeutics, estrogens; antibacterials; antibiotics; anti-fungals; anti-virals; anticoagulants; anticonvulsants; antidepressants; antihistamines; and immunological agents.

Other examples of suitable bioactive agents which may be included in accordance with the present disclosure include viruses and cells, peptides, polypeptides and proteins, analogs, muteins, and active fragments thereof, such as immunoglobulins, antibodies, cytokines (e.g. lymphokines, monokines, chemokines), blood clotting factors, hemopoietic factors, interleukins (IL-2, IL-3, IL-4, IL-6), interferons (β-IFN, (α-IFN and γ-IFN), erythropoietin, nucleases, tumor necrosis factor, colony stimulating factors (e.g., GCSF, GM-CSF, MCSF), insulin, anti-tumor agents and tumor suppressors, blood proteins, fibrin, thrombin, fibrinogen, synthetic thrombin, synthetic fibrin, synthetic fibrinogen, gonadotropins (e.g., FSH, LH, CG, etc.), hormones and hormone analogs (e.g., growth hormone), vaccines (e.g., tumoral, bacterial and viral antigens); somatostatin; antigens; blood coagulation factors; growth factors (e.g., nerve growth factor, insulin-like growth factor); bone morphogenic proteins, TGF-B, protein inhibitors, protein antagonists, and protein agonists; nucleic acids, such as antisense molecules, DNA, RNA, RNAi; oligonucleotides; polynucleotides; and ribozymes.

Devices formed with the fibers of the present disclosure, such as a mesh, may be at least partially coated with a bioresorbable coating by a surface treatment for enhanced properties. For example, the coating may be collagen, chitosan, polysaccharides, or mixtures thereof. The polysaccharides may be hyaluronic acid, alginic acid, polyglucuronic acid, chitosan, starch, soluble cellulose derivatives, and mixtures thereof. Such a coating makes it possible to eliminate crevices which may form during the construction and interplay of the fibers where bacteria or inflammatory cells may develop, thus making it possible to reduce the risk of inflammation and sepsis by preventing the installation of undesirable bacteria and/or microorganisms and/or inflammatory cells into the filled or covered crevices.

While several embodiments of the disclosure have been described, it is not intended that the disclosure be limited thereto, as it is intended that the disclosure be as broad in scope as the art will allow and that the specification be read likewise. Therefore, the above description should not be construed as limiting, but merely as exemplifications of embodiments. Those skilled in the art will envision other modifications within the scope and spirit of the claims appended hereto.

What is claimed is:

1. A process comprising:

mixing first and second precursors each possessing a core and at least one functional group known to have click reactivity in a cycloaddition reaction in a hopper; and extruding the first and second precursors through an extrusion die to produce a filament, wherein crosslinking by cycloaddition reaction of the first and second precursors is catalyzed by transition metal ions introduced during the extruding of the first and second precursors.

2. The process according to claim 1, wherein the functional group of the first precursor is an azide group and the functional group of the second precursor is an alkyne group.

3. The process according to claim 1, wherein the first precursor and optionally the second precursor comprises a polyol core.

4. The process according to claim 3, wherein the polyol is selected from the group consisting of polyethers, polyesters, polyether-esters, polyalkanols, and combinations thereof.

5. The process according to claim 3, wherein the polyol comprises a polyether selected from the group consisting of polyethylene glycol, polypropylene glycol, polybutylene glycol, polytetramethylene glycol, polyhexamethylene glycol, cyclodextrin-polyethylene glycols, polyacetals, and combinations thereof.

6. The process according to claim 3, wherein the polyol comprises a polyester selected from the group consisting of trimethylene carbonate, e-caprolactone, p-dioxanone, glycolide, lactide, 1,5-dioxepan-2-one, polybutylene adipate, polyethylene adipate, polyethylene terephthalate, and combinations thereof.

7. The process according to claim 3, wherein the polyol comprises a poly(ether-ester) block.

8. The process according to claim 1, wherein the transition metal ions are selected from the group consisting copper, zinc, iron, aluminum, magnesium, and alloys thereof.

9. The process according to claim 8, wherein transition metal ions are copper ions selected from copper sulfate, copper iodide, and combinations thereof.

10. The process according to claim 1, wherein the transition metal ions are leached from a metal surface.

11. The process according to claim 1, wherein the transition metal ions are coated on a surface as a chelating resin.

12. The process according to claim 1, wherein the transition metal ions are present on mixing blades of the hopper.

13. The process according to claim 1, wherein the transition metal ions are present on the extrusion die.

14. The process according to claim 1, wherein the transition metal ions are present in a cartridge coupled to the extrusion die.

15. The process according to claim 1, further comprising the step of quenching the filament in a quench bath after extrusion.

16. The process according to claim 15, wherein the transition metal ions are present in the quench bath.

17. A filament obtained by: mixing first and second precursors each possessing a core and at least one functional group known to have click reactivity in a cycloaddition reaction in a hopper; and extruding the first and second precursors through an extrusion die to produce a filament, wherein crosslinking by cycloaddition reaction of the first and second precursors is catalyzed by transition metal ions introduced during the extruding of the first and second precursors.

18. A fiber comprising a filament according to claim 17.

* * * * *